US010227212B2

(12) United States Patent
Alasentie

(10) Patent No.: US 10,227,212 B2
(45) Date of Patent: Mar. 12, 2019

(54) ELEVATOR ARRANGEMENT AND METHOD

(71) Applicant: KONE Corporation, Helsinki (FI)

(72) Inventor: Pentti Alasentie, Espoo (FI)

(73) Assignee: KONE CORPORATION, Helsinki (FI)

( * ) Notice: Subject to any disclaimer, the term of this patent is extended or adjusted under 35 U.S.C. 154(b) by 646 days.

(21) Appl. No.: 14/264,781

(22) Filed: Apr. 29, 2014

(65) Prior Publication Data

US 2014/0231179 A1 Aug. 21, 2014

Related U.S. Application Data

(63) Continuation of application No. PCT/FI2012/051174, filed on Nov. 28, 2012.

(30) Foreign Application Priority Data

Nov. 28, 2011 (FI) ..... 20116190

(51) Int. Cl.
*B66B 7/06* (2006.01)
*B66B 11/00* (2006.01)
*B66B 19/00* (2006.01)

(52) U.S. Cl.
CPC ..... *B66B 11/0045* (2013.01); *B66B 7/062* (2013.01); *B66B 11/009* (2013.01); *B66B 19/00* (2013.01)

(58) Field of Classification Search
CPC ... B66B 11/009; B66B 11/0045; B66B 19/02; B66B 19/04; B66B 7/068
See application file for complete search history.

(56) References Cited

U.S. PATENT DOCUMENTS

2005/0150728 A1* 7/2005 Van Der Meijden ..... B66B 19/002 187/411
2006/0225965 A1* 10/2006 Siewert ..... B66B 7/10 187/250

(Continued)

FOREIGN PATENT DOCUMENTS

CN 1336900 A 2/2002
CN 101535165 A 9/2009

(Continued)

OTHER PUBLICATIONS

AIPN, Machine Translation, JP 07 069559 A, dated Jul. 11, 2016, pp. 1-8.*
Machine Translation of JPH 07-69559.*

*Primary Examiner* — Diem M Tran
(74) *Attorney, Agent, or Firm* — Birch, Stewart, Kolasch & Birch, LLP

(57) ABSTRACT

An elevator arrangement, includes an elevator hoistway, an elevator car, which is arranged to travel in the elevator hoistway, a counterweight, a movable supporting platform above the elevator car, suspension roping, which is connected to the elevator car and to the counterweight, and supports them while suspended from the supporting platform, and a hoisting machine, which includes a device configured to move the roping. The elevator arrangement also includes a hoisting machine and traction roping that are separate from the supporting platform, which hoisting machine is in power transmission connection via the traction roping with the elevator car and with the counterweight.

17 Claims, 1 Drawing Sheet

(56) References Cited

U.S. PATENT DOCUMENTS

| | | | | |
|---|---|---|---|---|
| 2010/0163347 | A1* | 7/2010 | Van Der Meijden | B66B 19/00 187/254 |
| 2011/0113720 | A1* | 5/2011 | Peacock | B66B 19/00 52/741.1 |
| 2012/0217101 | A1* | 8/2012 | Peacock | B66B 11/0045 187/414 |
| 2013/0118838 | A1* | 5/2013 | Plathin | B66B 19/02 187/251 |

FOREIGN PATENT DOCUMENTS

| | | | | | |
|---|---|---|---|---|---|
| EP | 1555233 | A1 * | 7/2005 | | B66B 7/062 |
| JP | 07069559 | A * | 3/1995 | | |
| JP | 2003238047 | A * | 8/2003 | | |
| WO | WO 98/29327 | A1 | 7/1998 | | |
| WO | WO 0007923 | A1 * | 2/2000 | | B66B 19/00 |
| WO | WO 00/50328 | A2 | 8/2000 | | |
| WO | WO 2004050526 | A1 * | 6/2004 | | B66B 19/00 |
| WO | WO 2005/084185 | A2 | 9/2005 | | |
| WO | WO 2007128859 | A1 * | 11/2007 | | B66B 19/02 |
| WO | WO 2008/059100 | A2 | 5/2008 | | |
| WO | WO 2009/034224 | A1 | 3/2009 | | |
| WO | WO 2009026730 | A1 * | 3/2009 | | D07B 1/141 |
| WO | WO 2010/100319 | A1 | 9/2010 | | |
| WO | WO 2011/080387 | A1 | 7/2011 | | |
| WO | WO 2011148033 | A1 * | 12/2011 | | B66B 19/005 |

* cited by examiner

ELEVATOR ARRANGEMENT AND METHOD

FIELD OF THE INVENTION

The object of the invention is an elevator arrangement and a method in the fabrication of an elevator, which elevator is preferably an elevator applicable to passenger transport and/or freight transport, and in which method and elevator arrangement the elevator is taken/can be taken into service use already during the time of its construction.

BACKGROUND OF THE INVENTION

In connection with so-called jump-lifts, the elevator hoistway is taken into use already before the full length of the elevator hoistway has been completed. The top part of the elevator hoistway is constructed at the same time as an elevator car moving in the already completed bottom part of the elevator hoistway serves people on the lower floors of the building. In jump-lifts, the elevator car moving in the lower part of the elevator hoistway is supported and moved during the construction-time use suspended on hoisting ropes that are supported by a supporting platform in the elevator hoistway, which ropes are moved with a hoisting machine that is usually supported on the supporting platform. Installation work is done in the parts of the elevator hoistway above this supporting platform. When the part of the elevator hoistway under construction above the supporting platform has reached a sufficient stage of readiness, the completed part of the elevator hoistway can be taken into use. In this case a jump-lift is performed, wherein the supporting platform is lifted to a higher position in the elevator hoistway, thus extending the operating range of the elevator car upwards. A worksite crane in use in the construction of the building can, for example, be used for the lifting. Alternatively it has been possible to move the machine room platform that is being supported in the lifting on a support structure in the hoistway above the machine room platform.

When the elevator hoistway has reached its final height, the machine room platform has usually been removed from the elevator hoistway and the final hoisting machine of the elevator has been brought into a machine room built at the end of the elevator hoistway. As a conclusion to the installation method the construction-time roping is often removed and the elevator is reeved again with the final roping. One solution according to prior art is described in publication WO 2010100319 A1.

A problem in prior-art solutions has been that the hoisting arrangements needed for lifting the supporting platform are very space-consuming, are complex and are not sufficiently quick to use. More particularly the support points needed for shifting and positioning the machine room platform are difficult to arrange. It would not be desirable to separately arrange numerous support points in a building. It has been noticed that the difficulty of finding support points that are sufficiently stable and durable effectively limits the maximum height to which a jump-lift can, with a reasonable work input, reach. A worksite crane must sometimes be used for shifting the machine room platform, because the aforementioned problems make other solutions so awkward. Another problem has been, generally speaking, the demanding installation environment, which has set numerous practical challenges, which are connected to the smooth-running and safety of the installation and to the durability of structures. These are, inter alia, the space usage and complexity of the hoisting arrangement of the machine room platform, the center of mass and stability of the machine room platform during the lifting and while in position, the center of mass and stability of the support arrangement to be used for the lifting during the lifting and while in position, the placement producing a suitable balance of the support locking mechanism, the cramped layout of the machine room platform, suitable hoisting devices, the dimensioning of the hoisting machine for the final travel height, routing of the ropes with adequate run clearances, correct configuration of the rope length, the need for safe and spacious working space and position. These numerous variables that must be taken into account affect each other directly or indirectly and their overall effect is that the structure easily becomes complex and heavily built, and requires a lot of space. Taking these challenges into account, there has been a need to further simplify the support structure to be lifted in a jump lift and to reduce the weight to be lifted in a jump lift. Likewise, there has been a need to further develop the safety and speed of the method.

BRIEF DESCRIPTION OF THE INVENTION

The aim of the present invention is to solve the aforementioned problems of prior-art solutions as well as the problems disclosed in the description of the invention below. The aim is thus to produce an improved method in the fabrication of an elevator and an improved construction-time elevator arrangement. With the solution according to the invention, it is possible to directly or indirectly affect numerous problems of jump-lifts.

The elevator arrangement according to the invention comprises an elevator hoistway, an elevator car, which is arranged to travel in the elevator hoistway, a counterweight, a movable supporting platform above the elevator car, and suspension roping, which is connected to the elevator car and to the counterweight, and supports them while suspended from the supporting platform. The elevator arrangement also comprises traction roping and a hoisting machine that are separate from the supporting platform, which hoisting machine comprises means for moving the traction roping. The hoisting machine is in power transmission connection via the traction roping with the elevator car and the counterweight. In this way the traction function is separate from the supporting platform, and the traction roping does not travel via the supporting platform. The loading and the complicating effect of the traction function on the supporting platform and on the structure of it is thus minimal. The corresponding effects on the system to be used for lifting the supporting platform, on the lifting operation itself, and on the support structures of the supporting platform can likewise be minimized. Lightness is particularly advantageous, so that in the lifting of the supporting platform the weight to be lifted is small, and the lift can be performed with a simple and lightweight arrangement, e.g. supported on the guide rails of the elevator car or of the counterweight. The solution also simply enables a larger part of the elevator functions that require handling by a person to be away from the supporting platform and consequently it is safely accessible, even during a jump-lift, making the lifting safer. Likewise the hoisting machine can simply form the final hoisting machine of the elevator, because it can be left as it is in its position after the method. Installing it into position is also quick in the initial phase of the method. Neither does the weight of it rest on the supporting platform, so that the supporting platform is in this respect simple and light to lift. The structure of the supporting platform as a whole is very simple and lightweight. Another advantage of the solution is that not much tension is exerted on the traction ropes, e.g. not as large a load as on the suspension ropes. Thus the structure of them can be dimensioned to be light, so that even if the material of them were heavy, e.g. metal, such a small number of them would be needed that the load exerted on the supporting platform by them is reasonable.

Preferably the hoisting machine is disposed in the proximity of the bottom end of the path of movement of the elevator car. Thus it is very accessible in connection with installation and even in connection with a jump-lift. It is quick to install and does not increase the weight of the supporting platform.

Preferably the hoisting machine is arranged to exert via the traction roping a downward pulling force on the elevator car or on the counterweight. Thus exerting with the hoisting machine a vertically downward pulling force on the elevator car or on the counterweight for acting on the force imbalance between them, and thereby for adjusting the movement of them, can be arranged.

In one preferred embodiment the hoisting machine is disposed in the elevator hoistway in the proximity of the bottom end of the path of movement of the elevator car. Thus a separate space is not needed for it. It can be supported e.g. on the base of the elevator hoistway or between the wall of the elevator hoistway and the path of movement of the elevator car (e.g. on the wall structures of the elevator hoistway).

In one preferred embodiment the hoisting machine is disposed in a space beside the elevator hoistway in the proximity of the bottom end of the path of movement of the elevator car. In this way its structure does not limit the range of movement of the elevator car. Likewise, working by it is simple when the elevator car is in use.

Preferably the traction roping and/or the suspension roping each comprise one or more ropes, which continue(s) via a clamp/clamps to the rope supply storage. The rope supply storage can comprise a length of rope required by at least one, preferably a plurality of, jump-lifts. In this way an increase in the range of movement of the elevator car is enabled as far as roping is concerned.

Preferably the suspension roping is connected to the elevator car and to the counterweight with a 1:1 suspension ratio and the traction roping is connected to the elevator car and to the counterweight with a 2:1 suspension ratio.

Preferably the arrangement comprises means for lifting the supporting platform higher up in the elevator hoistway.

Preferably the arrangement comprises guide rails, such as guide rails of the elevator car and/or of the counterweight, and in the arrangement when lifting the supporting platform the vertical support force is arranged to be taken from the guide rails of the elevator, and/or after the lifting of the supporting platform the supporting platform is arranged to be supported in its position in the elevator hoistway by locking it in the vertical direction to be supported by the guide rails. Thus the taking of support is simple to arrange, it is not needed to prepare support points for this purpose on the walls of the elevator hoistway.

Preferably the arrangement, more particularly the supporting platform, comprises means for the vertical support of the supporting platform in its position in the elevator hoistway, which means can be shifted between a state supporting the supporting platform in its position in the vertical direction and a state not supporting it in its position in the vertical direction, in which state supporting it in its position they rest on the elevator hoistway or on a structure installed in the elevator hoistway, such as e.g. supported on a guide rail/on guide rails, and in which state not supporting it in its position they do not rest on the aforementioned structure, and neither do they hamper the vertical transfer of the supporting platform in the hoistway.

Preferably the suspension roping and the traction roping comprise ropes that are different to each other in their material and/or in their cross-section. In this way the structure of them can be optimized according to the function of the hoisting roping. For example, the grip, price and weight of the ropings can thus be optimized.

In one preferred embodiment the suspension roping comprises one or more ropes of essentially round cross-sectional shape, and the traction roping comprises one or more belt-type ropes. With regard to the traction roping, high grip is advantageous. With regard to the suspension roping, the price, weight, longitudinal strength and structural simplicity are more important than the grip, in which case a cross-sectionally round rope is advantageous. These types of ropes are widely available, and can be fabricated to be inexpensive in price.

Preferably the suspension roping comprises one or more ropes, the power transmission capacity in the longitudinal direction of which is based at least essentially on non-metallic fibers in the longitudinal direction of the rope.

Preferably the traction roping comprises one or more ropes, the longitudinal power transmission capability of which ropes is based at least essentially on metal wires in the longitudinal direction of the rope, preferably the rope is steel wire rope or a belt, inside which is one or more steel ropes.

Preferably the aforementioned non-metallic fibers are synthetic fibers.

Preferably the aforementioned non-metallic fibers are polymer fibers (e.g. polyethylene fibers or nylon fibers) or aramid fibers. Thus they are light and sufficiently durable and inexpensive. Preferably the rope is a braided rope. A braided rope is conventional and known in the art and inexpensive to manufacture.

Preferably the rope comprises a power transmission part or a plurality of power transmission parts, for transmitting force in the longitudinal direction of the rope, which power transmission part is essentially fully of non-metallic material. Thus the rope can be formed to be very light.

Preferably the rope comprises a power transmission part or a plurality of power transmission parts, for transmitting force in the longitudinal direction of the rope, which power transmission part comprises non-metallic fibers in strand form.

Preferably the traction roping is connected both to the elevator car and to the counterweight. Preferably the suspension roping is connected to the elevator car and to the counterweight such that when the elevator car moves upwards the counterweight moves downwards, and vice versa, and the suspension roping travels via a diverting pulley that is in connection with the supporting platform. Preferably the traction means is rotating traction means, which can act directly on the roping, such as a traction sheave. Preferably the traction roping passes around the bottom of the traction means of the hoisting machine. Preferably the traction roping is suspended to hang from the elevator car and from the counterweight.

In the method according to the invention when fabricating the elevator, the elevator car, and the counterweight, and a movable supporting platform are installed in the elevator hoistway, and suspension roping is installed to connect the elevator car and the counterweight, and to support them suspended by a movable supporting platform while supported in its position above the elevator car, and the hoisting machine and traction roping are installed separate from the supporting platform such that the hoisting machine is in power transmission connection via the traction roping with the elevator car and with the counterweight, and the elevator car is taken into use to serve passengers and/or to transport freight, after which the elevator car is removed from the aforementioned use, and the service range of the elevator car is changed to reach higher up in the elevator hoistway by lifting the supporting platform higher up in the elevator hoistway. After the lift, the elevator car is taken back into the aforementioned use. In this way the elevator car can be taken into use already during construction of the building/elevator hoistway/elevator. With the method a lift can be performed quickly and with a simple arrangement, with corresponding advantages to those described earlier.

Preferably the elevator car and the counterweight are moved during the aforementioned use by exerting with the hoisting machine via the traction roping a vertical pulling force on the elevator car or on the counterweight, thus acting on the force imbalance between them, thereby controlling their movement.

Preferably the service range of the elevator car is changed to reach higher up in the elevator hoistway by shifting the supporting platform higher up in the elevator hoistway and by supplying more rope to the roping from the rope supply storage.

Preferably in the method the supporting platform is lifted taking vertical support force from the support arrangement that is above the supporting platform and supported in its position in the elevator hoistway.

Preferably in the method the supporting platform is lifted taking vertical support force from the guide rails of the elevator that extend to above the supporting platform, such as from the guide rails of the car and/or of the counterweight, in which case preferably at least most of, preferably essentially all, the vertical support force needed for lifting is taken from the aforementioned guide rails.

Preferably in the method after the lifting of the supporting platform it is supported in its position in the elevator hoistway by locking it in the vertical direction to be supported by the guide rails of the car and/or of the counterweight and/or to be supported by the guide rail brackets of these, or alternatively to be supported by the wall structures of the elevator hoistway.

Preferably before the lifting of the supporting platform the support arrangement is supported on the top ends of the guide rails of the elevator car, which top ends extend to essentially above the supporting platform, and that in the lifting the supporting platform is pulled with a hoist to higher up in the elevator hoistway taking the vertical support force needed for the lifting from the guide rails with the aforementioned support arrangement.

Preferably in the method the elevator is arranged to be according to what is described above.

The elevator is most preferably an elevator applicable to the transporting of people and/or of freight, which elevator is installed in a building, to travel in a vertical direction, or at least in an essentially vertical direction, preferably on the basis of landing calls and/or car calls. The elevator car preferably has an interior space, which is most preferably suited to receive a passenger or a number of passengers. The elevator preferably comprises at least two, preferably more, floor landings to be served. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments.

BRIEF DESCRIPTION OF THE FIGURES

The invention will now be described mainly in connection with its preferred embodiments, with reference to the attached drawings, wherein FIG. 1*a* diagrammatically presents an elevator arrangement according to the invention, when the elevator car is in use to serve passengers and/or to transport freight.

DETAILED DESCRIPTION OF THE INVENTION

Figure 1A:
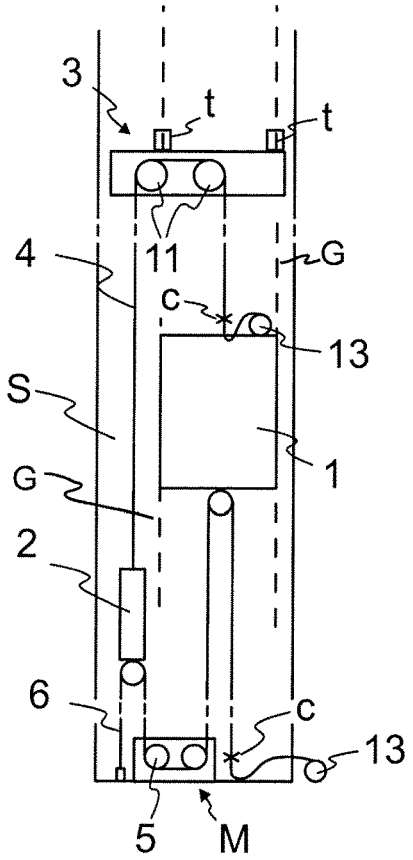
FIG. 1*b* diagrammatically presents an elevator arrangement according to the invention, when the elevator car is removed from the aforementioned use and the supporting platform supporting it is lifted higher in the elevator hoistway for changing the service range of the elevator car to reach higher up in the elevator hoistway.

FIG. 1*a* presents an elevator arrangement according to the invention, which arrangement is achieved by performing the phases of the method according to the invention in the fabrication of the elevator. In conclusion of the arrangement of FIG. 1*a* preferably the procedures of the method according to the invention have been performed. The figure presents an arrangement in a phase of the method, in which phase a partially completed elevator is used during the construction-time of the elevator, before the elevator hoistway S is completed throughout its full length. The elevator car 1 serves passengers in the already completed bottom part of the elevator hoistway S at the same time as the top part of the elevator hoistway S above the supporting platform 3 is being constructed. These work phases preferably include at least installation of the guide rails G. The elevator arrangement comprises a supporting platform 3, displaceable in the vertical direction in the elevator hoistway S, for supporting the elevator car 1 and also the counterweight 2 below it via hoisting roping 4. The elevator arrangement comprises means t for the vertical support of the supporting platform 3 in its position in the elevator hoistway 1, which means can be shifted between a state supporting the supporting platform 3 in its position in the vertical direction and a state not supporting it in its position in the vertical direction. Supported by the supporting platform 3 the aforementioned suspension roping 4 hangs in the elevator hoistway S, hanging more particularly while supported by the diverting pulley system 11 supported on the supporting platform 3, over which diverting pulley system 11 the suspension roping 4 travels. The suspension roping 4 is connected to the elevator car and to the counterweight such that when the elevator car moves upwards the counterweight moves downwards, and vice versa.

The elevator arrangement also comprises a hoisting machine M and traction roping 6 that are separate from the supporting platform 3, which hoisting machine M is in power transmission connection with the elevator car 1 and with the counterweight 2, via traction roping 6 that is separate from the suspension roping 4, for exerting with the hoisting machine M via the traction roping a vertical pulling force on the elevator car or on the counterweight for acting on the force imbalance between them, and thereby for adjusting the movement of them.

The hoisting machine M comprises means for moving the traction roping 6, which means preferably comprise a rotating traction means 5, which can act directly on the roping, preferably a traction sheave as is presented in the figures. The hoisting machine M comprises means for rotating the traction means 5, preferably an electric motor (not presented) and an automatic control of the rotating means, preferably thus an automatic control of the electric motor. The aforementioned hoisting machine M is arranged to act on the traction roping 6 such that it can pull the part of the roping on the first side of the hoisting machine (of the traction means 5 of it) or the part of the roping on the second side of the hoisting machine (of the traction means 5 of it), depending on the direction of rotation of the traction means, which direction can be selected to be that desired by the action of the control of the rotating means. The hoisting machine M is preferably arranged to exert via the traction roping 6 a downward pulling force on the elevator car 1 or on the counterweight 2. The hoisting machine M is preferably disposed in the proximity of the bottom end of the path of movement of the elevator car 1, as presented in the figures. The traction roping 6 is connected both to the elevator car 1 and to the counterweight 2. It is suspended to hang from the elevator car 1 and from the counterweight 2, in which case a downward pull is simple to implement.

The supporting platform 3 comprises the aforementioned means t for vertically supporting the supporting platform 3 in its position in the elevator hoistway S. In the state supporting the supporting platform 3 in its position they rest (in the vertical direction) preferably supported by the guide rails G comprised in the elevator. Thus after the lifting of the supporting platform 3, the supporting platform 3 is arranged to be supported in its position in the elevator hoistway S by locking it in the vertical direction to be supported by the guide rails G. Alternatively the means t can support the supporting platform 3 in its position in a supporting state resting (in the vertical direction) on some other structure installed in the elevator hoistway or an a structure of the elevator hoistway itself. In the aforementioned state not supporting it in position the means t do not hamper the vertical transfer of the supporting platform in the hoistway. The means t can be grippers to be manually tightened to the guide rails, or they can be means movable between an extended and retracted position in the lateral direction, as are known in the art.

The traction roping 6 and the suspension roping 4 each comprise one or more ropes, which continues(s) via an openable clamp/openable clamps c to the rope supply storage 13, which rope supply storage 13 comprises at least one rope, preferably a plurality of ropes, belonging to the roping in question of the length required for the lifting (a jump-lift) of the supporting platform 3.

The suspension roping 4 is preferably connected to the elevator car 1 and to the counterweight 2 with a 1:1 suspension ratio. In this way the suspension roping and the supporting platform can be formed to be very simple. The rope supply storage 13 can be in connection with the elevator car, where it is easily accessible. One end of the roping 4 continues via the rope clamp c to the rope supply storage 13 of the elevator car, and the other end of the roping 4 is fixed to the counterweight 2. The traction roping 6 is preferably connected to the elevator car 1 and to the counterweight 2 with a 2:1 suspension ratio. In this way the rope supply storage 13 of the traction roping 6 can be easily disposed in a suitable location and roping can be fed into the system simply while working in the area of the bottom end of the hoistway S. One end of the roping 6 continues via the rope clamp c to the rope supply storage 13 and the other end is fixed to the building, preferably to the elevator hoistway S.

The arrangement additionally comprises means (20, 21, 22) for lifting the supporting platform 3 higher in the elevator hoistway. In the lifting, it is arranged that vertical support force is taken from the support arrangement 20 that is supported in its position in the elevator hoistway above the supporting platform. In the arrangement, when lifting the supporting platform 3, the vertical support force is arranged to be taken from the guide rails G of the elevator, via the support arrangement 20. Thus the arrangement comprises guide rails G, which are preferably guide rails for guiding the movement of the elevator car 1. More particularly the means (20,21,22) are arranged to take vertical support force in the lifting of the supporting platform 3 from the guide rails G of the elevator that extend to above the supporting platform 3. In this case preferably at least most, preferably essentially all, the vertical support force needed for lifting is arranged to be taken from the aforementioned guide rails.

Figure 1B:
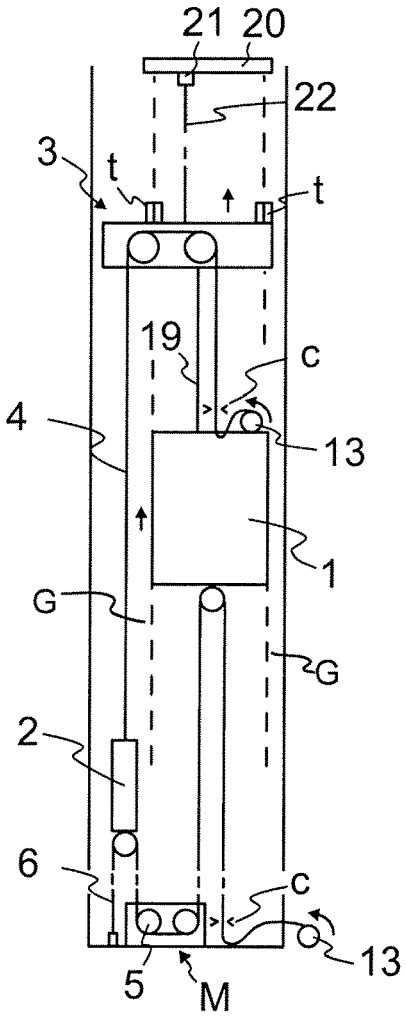
Figure 2:
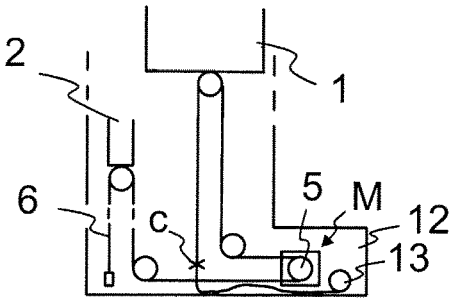
FIG. 2 presents an alternative placement for the hoisting machine of the elevator.

In the embodiment of FIG. 1, the hoisting machine M is disposed in the elevator hoistway S in the proximity of the bottom end of the path of movement of the elevator car 1. In the embodiment of FIG. 2, the hoisting machine M is disposed in a space 12 next to the elevator hoistway S in the proximity of the bottom end of the path of movement of the elevator car 1. Otherwise the solutions are similar, and are as described above.

Figure 4:
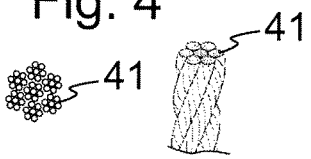
FIG. 4 presents a preferred structure for the rope of the suspension roping and/or of the traction roping

The ropes of the suspension roping 4 and the ropes of the traction roping 6 can be any according to prior art, e.g. all metal ropes. Likewise they can be of any cross-sectional shape according to prior art, such as e.g. round. However, since the suspension and the traction are differentiated from each other, the suspension roping 4 performing the suspension function and the traction roping 6 performing the traction function can be different to each other, more particularly such that they comprise different ropes, and/or a different amount of ropes, to each other. This achieves the benefit that their properties can be configured to be best suited for their function (suspension/traction). For example, the weight of a rope of the suspension roping 4 can be configured to be low because its purpose is only to bear a longitudinal load, and frictional traction does not need to be exerted on it. Lightness is particularly advantageous, so that in the lifting of the supporting platform 3 the weight to be lifted would be small, and the lift could be performed with a simple and lightweight arrangement, e.g. supported on the guide rails G. Lightness would likewise be advantageous, so that the rope storage 13 can be disposed in connection with the elevator car 1 without problems caused by the rope coil in a driving situation of the elevator car 1. Thus the hoisting roping 4 preferably comprises one or more ropes, the longitudinal power transmission capability of which ropes is based at least essentially on non-metallic fibers in the longitudinal direction of the rope. The aforementioned non-metallic fibers can be synthetic fibers, ropes manufactured from which being also commercially available. Most preferably the aforementioned non-metallic fibers are polymer fibers or aramid fibers. Preferred polymers are inter alia polyethylene and nylon, ropes manufactured from which are commercially available, e.g. from marine rope suppliers. Alongside being light, these types of ropes are cheap and they are cheap to replace on finalizing the installation with the final elevator ropes. They also structurally withstand the tightening of the rope clamp c well. Since grip (e.g. friction) does not need to be transmitted via them for controlling the movement of the elevator car and of the counterweight, there are no special criteria for their surface structure. In this case the structure of the rope is preferably such that it comprises a power transmission part or a plurality of power transmission parts, for transmitting force in the longitudinal direction of the rope, which power transmission part is essentially fully of non-metallic material. The aforementioned power transmission part comprises non-metallic fibers in strand form, and the rope is preferably a braided rope in its structure. The rope can be e.g. of the type presented in FIG. 4 in its cross-sectional shape, in which case the strands 41 of the rope of the figure are formed from a plurality of non-metallic fibers or fiber bundles.

The traction roping 6 is preferably such that it comprises one or more ropes, the longitudinal power transmission capability of which ropes is based at least essentially on metal wires in the longitudinal direction of the rope, preferably the rope is steel wire rope. In this way it is well suited to a function requiring grip, in which the rotating traction means 5 (preferably a traction sheave) of the hoisting machine M exerts a longitudinal pull on its surface, the magnitude of which force depends in the grip of the traction means and of the rope of the traction roping. A metal rope withstands well the stresses of the rope clamp c and is reliable. The metal rope is preferably essentially round in its cross-section. The metal rope can be a braided metal rope, e.g. of the type in FIG. 4, in which case each of the strands 41 of the rope of the figure, which strands are load-bearing parts, is formed from a plurality of metal wires.

Figure 3:
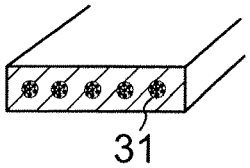
FIG. 3 presents a preferred structure for the rope of the suspension roping and/or of the traction roping.

The ropes of the suspension roping and of the traction roping can, however, be of a different type than what is presented above. For example, one or more rope of the traction roping 6 can be a belt, such as a flat belt, or a Poly-V belt suited to the grooving of the traction means, or a toothed belt suited to the toothing of the traction means, with which specifically the grip can be made to be very good by the aid of a large contact surface/toothing. In this case the longitudinal power transmission capability of the rope can be based e.g. on metal wires, preferably the rope is a belt comprising a number of steel wire braids, preferably parallel ones, inside an elastomer surface. The ropes of the suspension roping 6 preferably do not comprise toothing, so that the structure of the suspension ropes would be simple and light. The ropes of the suspension roping 6 are preferably essentially round in their cross-section. Belt-type ropes per se are known in the art. The belt can be e.g. of the type presented in FIG. 3, in which case the belt-type rope comprises a parallel plurality of metal wire braids 31, which are the load-bearing parts of the rope, and which braids 31 are in a polymer, which can be e.g. polyurethane.

In the method according to the invention in the fabrication of an elevator, the elevator car 1, and the counterweight 2, and the movable supporting platform 3 are installed in the elevator hoistway S. In addition, the suspension roping 4 is installed to connect the elevator car 1 and the counterweight 2, and to support them while suspended by a movable supporting platform 3 supported in its position above the elevator car 1. In addition, the hoisting machine M and traction roping 6 are installed separate from the supporting platform 3, such that the hoisting machine M is in power transmission connection via the traction roping 6 with the elevator car and with the counterweight 2. In this way the traction function is separate from the supporting platform 3, and the loading and the complicating effect caused by it on the supporting platform 3 and on the structure of it can be minimized. Likewise, the corresponding effects on the system lifting the supporting platform 3, on the lifting operation itself, and on the support structures of the supporting platform can be minimized. Lightness is particularly advantageous, so that in the lifting of the supporting platform 3 the weight to be lifted is small, and the lift can be performed with a simple and lightweight arrangement, e.g. supported on the guide rails G of the elevator car. The solution also simply enables a larger part of the elevator functions requiring a person's presence to be away from the supporting platform 3, and consequently it is safely accessible, even during a jump-lift. Likewise the hoisting machine M can simply form the final hoisting machine of the elevator, because it can be left as it is in its position after the method. Installing it into position is also quick in the initial phase of the method, because it can be brought into its position in the hoistway S or in the aforementioned space 12 (or at least partly into the immediate proximity of its installation location) simply, e.g. with a forklift truck. Neither does the weight of it rest supported on the supporting platform 3, so that the supporting platform 3 is in this respect simple and light to lift. Overall the structure of the supporting platform 3 is very simple and light. The supporting platform 3 is movable, i.e. the elevator arrangement (most preferably the supporting platform 3 itself, as is presented in the figures) comprises means t for the vertical support of the supporting platform 3 in its position in the elevator hoistway S, which means t can be shifted between a state supporting the supporting platform 3 in its position in the vertical direction and a state not supporting it in its position in the vertical direction, in which state supporting it in its position they rest on the elevator hoistway or on a structure installed in the elevator hoistway, preferably supported on a guide rail/on guide rails G, and in which state not supporting it in its position they do not hamper the vertical transfer of the supporting platform in the hoistway. In FIG. 1*a*, the supporting platform 3 is supported in its position in the elevator hoistway S with the means t. After the installation of the ropings 4 and 5 and the machine M, the elevator car 1 is taken into use to serve passengers and/or to transport freight. During the use, the structures above the supporting platform 3, e.g. the elevator hoistway S or the guide rails G of the elevator car 1, are constructed/installed. When the structures above the supporting platform 3 are sufficiently completed, preparations are made for the next jump-lift. These preparations can comprise supporting, before the lifting of the supporting platform 3, a support arrangement 20 on the top ends of the guide rails G of the elevator car 1, which top ends extend to essentially above the supporting platform 3. At the latest after this the elevator car 1 is removed from the aforementioned use. After this the supporting platform 3 is taken onto the support of the hoisting arrangement 20,21,22 and the rope clamps c are released, and the vertical support of the supporting platform 3 is released, i.e. the means t are shifted into the state not supporting the supporting platform 3 in its position in the vertical direction. In the lifting the supporting platform 4 is pulled with a hoist 21 to higher up in the elevator hoistway 1, preferably thus taking the vertical support force needed for the lifting from the guide rails G with the aforementioned support arrangements (20,21,22), as is presented in FIG. 1*b*. Preferably at least most, preferably essentially all, the vertical support force needed for lifting is taken from the aforementioned guide rails G. The guide rails are presented in the figure with a dashed line only partly for the sake of simplicity, but they continue preferably from the bottom part of the elevator hoistway to the supporting platform, and to so far above it as there has been time to install them at the time. After being taken out of use the elevator car 1 is preferably supported by the supporting platform 3 via a suspension member 19, so that it rises along with the supporting platform. This is not however necessary, but instead the car 1 could also be in its position also during the lift. During the lifting of the supporting platform, rope is released fro the rope storages 13 of the ropings 4 and 6. When the supporting platform 3 has been lifted to its target height, the means t are shifted into the state supporting the supporting platform 3 in its position in the vertical direction, the rope clamps c are fixed, and the elevator car 1 is taken back into the aforementioned use, in which it is driven with the hoisting machine M in the manner described earlier. Thus in the aforementioned use the elevator car 1 and the counterweight 2 are moved, e.g. for serving car calls and/or landing calls, by exerting with the hoisting machine 5 via the traction roping 6 a vertical pulling force on the elevator car 1 or on the counterweight 2, thus acting on the force imbalance between them, thereby controlling their movement. In the method the elevator arrangement is preferably according to any those described earlier. The necessary amount of lifts of the type described above are performed, taking the elevator car 1 into the aforementioned use in between the lifts. A lift is performed in the manner described in FIG. 1*b*, and the conclusion after the lift is the situation presented by FIG. 1*a*, albeit with the supporting platform being higher in the hoistway S.

Although preferred methods of implementing the phases of the method are presented above, it is obvious that some of the phases of the method can be implemented in a different manner. Although the solution in question is very advantageous, the advantages of the invention are obtained even if e.g. the supporting platform is lifted otherwise than with a hoisting arrangement that is in the elevator hoistway. Likewise, although the supporting on the guide rails of the supporting platform in its position is an advantageous way to support without modifying the hoistway structure, owing to the invention the solution is also simple and space-efficient even if it were locked elsewhere.

It is obvious to the person skilled in the art that in developing the technology the basic concept of the invention can be implemented in many different ways.

The invention and the embodiments of it are not therefore limited to the examples described above, but instead they may be varied within the scope of the claims.

The invention claimed is:

1. An elevator arrangement, comprising:

an elevator hoistway;

an elevator car, which is arranged to travel in the elevator hoistway;

a counterweight;

guiderails;

a movable supporting platform above the elevator car, the movable supporting platform comprising at least one diverting pulley and two supports, each support being attached to one of the guiderails;

a suspension roping comprising a suspension roping first end connected to a first rope supply storage that is disposed on the elevator car and a suspension roping second end connected to the counterweight, the suspension roping supports the elevator car and the counterweight while suspended from the movable supporting platform;

a traction roping comprising a traction roping first end connected to a second rope supply storage disposed outside the elevator hoistway and a traction roping second end fixedly connected to a bottom of the elevator hoistway;

a hoisting machine and the traction roping are separate from the movable supporting platform, which hoisting machine is in power transmission connection via the traction roping with the elevator car and with the counterweight;

a first clamp configured to clamp the suspension roping, the first clamp is located on the suspension roping between the at least one diverting pulley and the first rope supply storage; and a second clamp configured to clamp the traction roping, the second clamp is located on the traction roping between the hoisting machine and the second rope supply storage, wherein the movable supporting platform is lifted taking vertical support force from a support arrangement that is above the supporting platform and supported in its position in the elevator hoistway, and wherein the support arrangement is fixed to top ends of the guide rails.

2. The elevator arrangement according to claim 1, wherein the hoisting machine is disposed in a proximity of a bottom end of the path of movement of the elevator car.

3. The elevator arrangement according to claim 2, wherein the hoisting machine is arranged to exert via the traction roping a downward pulling force on the elevator car or on the counterweight.

4. The elevator arrangement according to claim 1, wherein the hoisting machine is arranged to exert via the traction roping a downward pulling force on the elevator car or on the counterweight.

5. The elevator arrangement according to claim 1, wherein the traction roping is suspended to hang from the elevator car and from the counterweight.

6. The elevator arrangement according to claim 1, further comprising a device configured to lift the movable supporting platform higher up in the elevator hoistway.

7. The elevator arrangement according to claim 1, wherein when lifting the movable supporting platform, a vertical support force is arranged to be taken from the guide rails of the elevator, and/or after the lifting of the movable supporting platform, the movable supporting platform is arranged to be supported in the elevator hoistway by locking the movable supporting platform in the vertical direction to be supported by the guide rails.

8. The elevator arrangement according to claim 1, wherein the supports vertically support the movable supporting platform in the elevator hoistway, the supports being configured to vertically support the movable supporting platform being shiftable between a state supporting the moveable supporting platform in a vertical direction and a state not supporting the movable supporting platform in the vertical direction, in which state supporting the movable supporting platform, the supports rest on the elevator hoistway or on a structure installed in the elevator hoistway, and in which state not supporting the movable supporting platform, the supports do not hamper the vertical transfer of the movable supporting platform in the hoistway.

9. The elevator arrangement according to claim 1, wherein the suspension roping includes ropes that are different to the traction roping in their material and/or in their cross-section.

10. The elevator arrangement according to claim 1, wherein the suspension roping includes one or more ropes of essentially round cross-sectional shape, and the traction roping comprises one or more belts.

11. The elevator arrangement according to claim 1, wherein the suspension roping includes one or more ropes, a longitudinal power transmission capability of which ropes is based at least essentially on non-metallic fibers in the longitudinal direction of said suspension roping.

12. The elevator arrangement according claim 1, wherein the suspension roping includes one or more ropes, a longitudinal power transmission capability of which ropes is based at least essentially on metal wires in the longitudinal direction of said suspension roping.

13. A method for fabricating an elevator, comprising the steps of:

installing guiderails, an elevator car, a counterweight, and a movable supporting platform in an elevator hoistway, the movable supporting platform comprising at least one diverting pulley and two supports, each support being attached to one of the guiderails;

installing suspension roping to connect the elevator car and the counterweight, and to support them while suspended by the movable supporting platform supported above the elevator car, the suspension roping comprises a suspension roping first end connected to a first rope supply storage disposed on the elevator car and a suspension roping second end connected to the counterweight;

installing a hoisting machine and traction roping separate from the movable supporting platform, such that the hoisting machine is in power transmission connection via the traction roping with the elevator car and with the counterweight, the traction roping comprises a traction roping first end connected to a second rope supply storage disposed outside the elevator hoistway and a traction roping second end fixedly connected to a bottom of the elevator hoistway;

installing a first clamp at the suspension roping between the at least one diverting pulley and the first rope supply storage;

installing a second clamp at the traction roping between the hoisting machine and the second rope supply storage;

taking the elevator car into use to serve passengers and/or to transport goods;

removing the elevator car from said use;

changing the service range of the elevator car to reach higher up in the elevator hoistway by lifting the movable supporting platform higher up in the elevator hoistway; and taking the elevator car back into said use, wherein the movable support platform is lifted via a support arrangement fixed to top ends of the guide rails.

14. The method according to claim 13, wherein the elevator car and the counterweight are moved during said use by exerting with the hoisting machine via the traction roping a vertical pulling force on the elevator car or on the counterweight, thus acting on a force imbalance between them, thereby controlling their movement.

15. The method according to claim 13, wherein the service range of the elevator car is changed to reach higher up in the elevator hoistway by shifting the movable supporting platform higher up in the elevator hoistway, and by supplying more rope from the first rope supply storage and the second rope supply storage.

16. The method according to claim 13, wherein the movable supporting platform is lifted taking vertical support force from the guide rails of the elevator that extend to above the movable supporting platform.

17. The method according to claim 13, wherein after the lifting of the movable supporting platform it is supported in its position in the elevator hoistway by locking it in the vertical direction to be supported by the guide rails.

* * * * *